US011939730B2

(12) United States Patent
van Voorst et al.

(10) Patent No.: US 11,939,730 B2
(45) Date of Patent: Mar. 26, 2024

(54) SPLIT RESISTANT FIBRE

(71) Applicant: Ten Cate Thiolon B.V., Nijverdal (NL)

(72) Inventors: Gerjan van Voorst, Nijverdal (NL); Frank Pfeiffer, Nijverdal (NL); Niels Gerhardus Kolkman, Nijverdal (NL)

(73) Assignee: Ten Cate Thiolon B.V., Nijverdal (NL)

( * ) Notice: Subject to any disclaimer, the term of this patent is extended or adjusted under 35 U.S.C. 154(b) by 1117 days.

(21) Appl. No.: 16/464,699

(22) PCT Filed: Nov. 30, 2017

(86) PCT No.: PCT/NL2017/050801
§ 371 (c)(1),
(2) Date: May 29, 2019

(87) PCT Pub. No.: WO2018/101827
PCT Pub. Date: Jun. 7, 2018

(65) Prior Publication Data

US 2019/0323179 A1 Oct. 24, 2019

(30) Foreign Application Priority Data

Nov. 30, 2016 (NL) ..... 2017901

(51) Int. Cl.
*E01C 13/08* (2006.01)
*D01D 5/253* (2006.01)
*D02G 3/44* (2006.01)

(52) U.S. Cl.
CPC ..... *E01C 13/08* (2013.01); *D01D 5/253* (2013.01); *D02G 3/444* (2013.01); *D10B 2401/063* (2013.01); *D10B 2505/202* (2013.01)

(58) Field of Classification Search
None
See application file for complete search history.

(56) References Cited

U.S. PATENT DOCUMENTS

2013/0004683 A1 1/2013 Auguste

FOREIGN PATENT DOCUMENTS

| | | | |
|---|---|---|---|
| AU | 2010212281 | * | 3/2011 |
| CN | 203462184 | | 3/2014 |
| DE | 102009052848 | | 5/2011 |
| EP | 2039831 | | 3/2009 |
| GB | 1166361 | | 10/1969 |
| JP | 9111532 | | 4/1997 |
| KR | 1020090041781 | | 4/2009 |
| KR | 101357683 | | 2/2014 |
| WO | 2011027235 | | 3/2011 |

* cited by examiner

*Primary Examiner* — Shawn Mckinnon
(74) *Attorney, Agent, or Firm* — N.V. Nederlandsch Octrooibureau

(57) ABSTRACT

A fibre for use in artificial turf has an elongate cross-sectional shape defining a first face and a second face that meet at side edges of the fibre. The first and second faces having respective first and second ridges that are offset with respect to each other, such that the cross-sectional shape is 2-fold rotationally symmetric with no reflectional symmetry. The fibre may be an extruded monofilament and shows improved resilience over symmetrical fibres of similar dimensions.

20 Claims, 2 Drawing Sheets

"Amended"

SPLIT RESISTANT FIBRE

FIELD OF THE INVENTION

The present invention relates to a fibre for use as pile in the manufacture of artificial turf and to artificial turf comprising such fibres.

BACKGROUND ART

Artificial turf has become steadily more accepted as a playing surface for various sports. It is also increasingly used for landscaping purposes. In both cases, its acceptance may be attributed to the steadily improving technology, which make artificial turf appear and perform more like real grass and also ensures that this remains the case during an acceptable lifetime.

It will be understood that one major difference between natural grass and artificial turf is the fact that the former grows and rejuvenates, while the later does not. Artificial turf, especially when used intensively, must be extremely resilient and resistant to wear and damage. On the other hand, it should also be as pleasant to play on as natural grass. These conflicting requirements are a constant problem for the designer of artificial turf systems and their components.

Reference to artificial turf systems may include a number of individual components that work together to make a playable or usable surface. These may include a base layer, an impermeable foil, a drainage layer, a shock pad, a backing layer in which the grass pile is anchored, the artificial pile itself and infill. The present invention is specifically directed to fibres forming the upstanding pile of the artificial grass although it will be understood that these fibres interact and interface with other components too.

It may also be noted that fibres for forming the pile of a carpet-like construction may be present in a number of different forms. Traditional carpets use twined fibres of cotton or synthetic yarn, with individual filaments twined together to form a single pile fibre and a number of fibres bundled together and either woven or tufted into a backing. In the context of artificial grass, fibrillated tape products have been used. These are produced by foil extrusion with the foil being subsequently slit into tape, which is then fibrillated with a specific pattern. The fibrillation improves the natural look and feel of the individual synthetic turf fibres after installation as an artificial turf pitch. A further category of fibre is known as the monofilament fibre. This term is generally intended to designate individually extruded filaments that are extruded from a die head that imparts a desired cross-sectional shape on the fibre. Extrusion in this manner allows a monofilament to be designed for an explicit purpose, whereby the cross-sectional shape is engineered for the intended functionality.

One example of an artificial turf monofilament is the Evolution™ fibre from Royal Ten Cate, as disclosed in WO 2005/005731. This curved fibre provides significantly improved resilience compared to similar weight fibres of more planar construction. Unfortunately, the improved resilience comes at the expense of durability and extended use trials show that the fibre is susceptible to splitting and cracking.

Another monofilament fibre is described in U.S. Pat. No. 6,432,505 as having a substantially diamond shaped cross section, which provides increased resistance to cracking and fibrillation while retaining useful flexibility and abrasion characteristics. Turf with a diamond shaped fibre of this form is available from Royal Ten Cate under the name Slide Max™. Even though this fibre has been shown to be extremely durable, its resilience is significantly lower than that of the Evolution™ and this may further deteriorate with time. Resilience may be reflected in the ball roll performance as measured e.g. according to the FIFA Handbook of Test Methods V2.4. It is also apparent in the ability of the fibre to remain upright after repeated deformation, which affects the appearance of the turf after a period of intensive use.

Fibre development is a complex process. The direct engineering properties of the fibre, such as stiffness and tensile strength, may be modelled and optimised based on material data and structural formulae. The secondary properties such as those tested according to the above FIFA test methods are more difficult to predict and can only be determined through extensive testing. Other properties such as weaving or tufting performance and manufacturing ability are equally complex and generally can only be established in practice. Fibres may also be mixed together in order to further tune the overall performance of the artificial turf.

Fibre pull-out is just such an example of a manufacturing related property that is of great significance to the acceptance of the final product. Fibrillated polymeric tape is notoriously slippery compared to twined fibres and tends to have low fibre pull-out values when woven or tufted. Additional provisions may be needed to improve these values, such as firmer weaves or coatings. Monofilaments are generally stiffer to weave than tape but are also not necessarily easily anchored in the weave or backing.

It would be desirable to provide a fibre that improved upon the properties of existing fibres for use in artificial turf.

SUMMARY OF THE INVENTION

According to the present invention, there is provided a fibre for use in artificial turf, the fibre having an elongate cross-sectional shape defining a first face and a second face that meet at side edges of the fibre, the first and second faces having respective first and second ridges that are offset with respect to each other, such that the cross-sectional shape is 2-fold rotationally symmetric with no reflectional symmetry. By 2-fold rotational symmetry is meant that the shape is identical when rotated about its centre by 180°. The absence of reflectional symmetry means that there is no line about which the shape can be reflected onto itself. A (non-rhomboid) parallelogram is an example of such a 2-fold rotationally symmetric shape that does not have reflectional symmetry. The cross-sectional shape of the present fibre may therefore fit within a parallelogram. The extremities of the side edges and the extremities of the first and second ridges may also define a parallelogram.

The resulting fibre has shown improved resilience with respect to similarly dimensioned symmetrical fibres, as illustrated by extended testing and visual inspection. Without wishing to be bound by theory, it is believed that this is due to the fact that the presently claimed fibre collapses differently to symmetrical fibres. In particular the asymmetry of the fibre causes the point at which the fibre buckles to vary from one cycle to the next, as opposed to symmetrical fibres which appear to have a tendency to repeatedly buckle at the same location.

The fibre may closely conform to the envelope of a parallelogram. More preferably however, the first and second faces have concave portions. In other words, the surfaces of the fibre may be displaced inwardly with respect to the surface of the corresponding parallelogram. The resulting fibre has relatively less material and a lower second moment of area about the centre line joining the side edges. Although the first and second faces may have convex portions, it is preferable that no part of the first and second faces crosses the centre line.

It will be noted that each of the first and second faces has a major face, being the portion between the ridge and the most distant side edge and a minor face, being the portion between the ridge and the closer side edge. Both the minor and the major faces may be concave. Alternatively, only the major faces may be concave, while the minor faces may be generally flat or even slightly convex or vice-versa. The shape of the faces is influential in the manner in which the fibres bind together at their attachment to the backing. This can also affect the fibre pull out strength, otherwise referred to as tuft-lock. Flat faces are believed to allow fibres to more easily slide past and over each other and the presently discloses concave surfaces are believed to be the basis for the improved pull-out values experienced with the present fibres.

The fibre may have smooth surfaces to the first and second faces. In a preferred embodiment, the first and second faces may be provided with corrugations. In this context, the term corrugations is intended to include grooves, ridges, curves, waves and other relief extending in the lengthwise direction of the fibre. These corrugations can help in making the appearance of the fibre less shiny and more grass-like by improving the diffusion of reflected light. It will be understood that the scale of the corrugations will be smaller than that of the first and second ridges on the respective first and second faces. In one embodiment, each face has between five and ten corrugations excluding a single ridge, which defines the maximum distance from the centre line. These corrugations are preferably continuous i.e. smooth curves although scallop-shaped curves may also be contemplated. The side edges are preferably also rounded and may have a radius of curvature of at least 0.05 mm. The first and second ridges are also preferably rounded with a radius of curvature of at least 0.1 mm.

As indicated above, the fibre cross-section is elongate, meaning that it is longer in the direction between the side edges than it is when measured at any point transverse to this direction. The actual dimension of the fibre may vary according to its intended use. For use in sports, a centre line extending between the side edges may have a length of between 0.5 mm and 2 mm, preferably between 1.0 mm and 1.5 mm, most preferably around 1.25 mm. Reference is given here to a centre line although it should be noted that this need not necessarily be the mid-line defined as the locus of the mid-point between the respective side faces. For the present purpose, the centre line is a straight line, which may deviate from the mid-line due to the asymmetric shape of the fibre. For landscaping purposes, different fibre dimensions may be applicable.

As a result of the elongate cross-sectional shape, a ratio between a maximum thickness of the fibre measured transverse to a centre line extending between the side edges and a length of the centre line may be between 0.25 and 0.6, preferably between 0.3 and 0.4. This point of maximum thickness will generally correspond to a location at or between the first and second ridges. The maximum thickness may vary between 0.2 mm and 0.6 mm and will preferably be between 0.3 mm and 0.5 mm. Thickness is determined according to FIFA requirements based on the largest diameter circle that can fit within the cross-section. An actual embodiment has a thickness of around 0.38 mm and a centre line length of around 1.2 mm.

For these fibres a second moment of area may be calculated, which may lie in the range of from 0.0010 mm4 to 0.0080 mm4, generally below 0.0040 mm4 and more generally below 0.0020 mm4. In a preferred embodiment, the second moment of area is around 0.0015 mm4.

As is customary in fibre technologies, the weight of the fibre may be defined by a dtex value representing the weight in grams of 10,000 metres of the fibre. In the present case, for sports use, the fibre may have a dtex value of between 1500 and 3000, preferably between 1800 and 2500 and in particular, values around 2000. For use in landscaping, lighter fibres may be preferred with dtex values of from 800 to 1500.

The first and second ridges may be offset by any appropriate amount to achieve the desired bending performance and asymmetry. It will be understood that in the case of a minimal offset, the fibre will perform in a closely similar manner to the above mentioned Slide Max™ diamond shaped fibre. As the ridges approach the side edges of the fibre, the performance may approach that of a flat fibre with bulbous ends. Maximum asymmetry may be achieved at the point at which the ridges are offset from each other by a distance of around half of the centre line length. In this context, offset is intended to refer to the distance between the ridges, measured along the centre line. This means that each of the ridges is offset from the mid-point of the centre line by one quarter of the centre line length. Most preferably, lower asymmetry is desirable and the ridges are preferably offset from each by a distance that is greater than 0.05× the centre line length but less than 0.4× the centre line length, preferably in the region between 0.1 and 0.2× the centre line length.

The skilled person will understand that such fibres will usually be extruded as individual monofilaments in a conventional extrusion of co-extrusion process. It is nevertheless, not excluded that any other suitable procedure or combination of procedures may be applied, including moulding, coating, multi-fibre extrusion and the like. Preferably, the fibre is drawn subsequent to extrusion at a draw ratio of between 2 and 5, preferably between 3 and 4. Drawing down serves to orientate the polymer and improves the mechanical properties of the final fibre, whereby properties such as modulus and tensile strength are different from those of the initial polymer material as supplied.

The fibre may be manufactured of any suitable polymeric material, in particular, those that are suitable for fibre extrusion. Suitable polymers include but are not limited to: polyamides (PA-6, PA-6,6); polyesters (PET, PTT, PBT, PLA, PHB); polypropylene (homopolymer, copolymer; regular and metallocene grades); polyethylene (HDPE, LDPE, LLDPE, regular [LLDPE] and metallocene [mLLDPE] grades); polyolefin block copolymers (OBC) and blends or co-extrusions of the above.

Preferred materials are polypropylene (homopolymer, copolymer; regular and metallocene grades); polyethylene (HDPE, LDPE, LLDPE, regular and metallocene grades), polyolefin block copolymers (OBC) and blends thereof whereby polyethylene (HDPE, LDPE, LLDPE, regular and metallocene grades) and polyolefin block copolymers (OBC) and their blends are the most preferable.

Co-extruded fibres may also be used, preferably in a core/cladding or inside/outside coextrusion. In one embodiment, the fibre may comprise Inside mLLDPE or mLLDPE+OBC and Outside LLDPE. The skilled person will nevertheless be aware of many alternative combinations of materials that may be applicable to further tailor the fibre properties.

The invention also relates to an artificial turf comprising upstanding pile fibres as described above or hereinafter, retained in a backing. The fibres may be tufted to the backing or woven together with the backing. Additionally, the pile may be uniform in that all fibres are identical of the fibres may be mixed with further pile fibres having different cross-sectional shapes. This may include other non-symmetrical fibres according to the invention or other fibres not themselves being according to the invention.

Additionally, the pile fibres may comprise fill fibres, these being shorter than the pile fibres and serving to support the pile fibres in an upright position. In this context, it is meant that the fill fibres are shorter in height in the use position. They may of course be curled or crimped and have an initial length that is larger.

The artificial turf may further comprise a quantity of infill between the fibres. This may be any suitable infill, including but not limited to rubber, cork, sand and bead infill.

The invention may be applicable to turf for various uses, although sports such as football, rugby and hockey are most appropriate. This will largely determine the pile height required. The pile fibres may have a pile height of more than 4 cm, preferably more than 5 cm and optionally between 6 cm and 7 cm. The pile may also be anchored into the backing over a distance of more than 10 mm or even more than 15 mm or more than 20 mm. Anchoring the pile may be by multiple W-weave, with the pile fibres passing over a number of weft yarns. A similar effect may be achieved in tufting. The turf may be woven in face to face configuration with pile fibre elements having both of their ends upstanding and an intermediate portion bound into the backing.

BRIEF DESCRIPTION OF THE DRAWINGS

The present invention will be discussed in more detail below, with reference to the attached drawings, in which.

DESCRIPTION OF EMBODIMENTS

Figure 1:
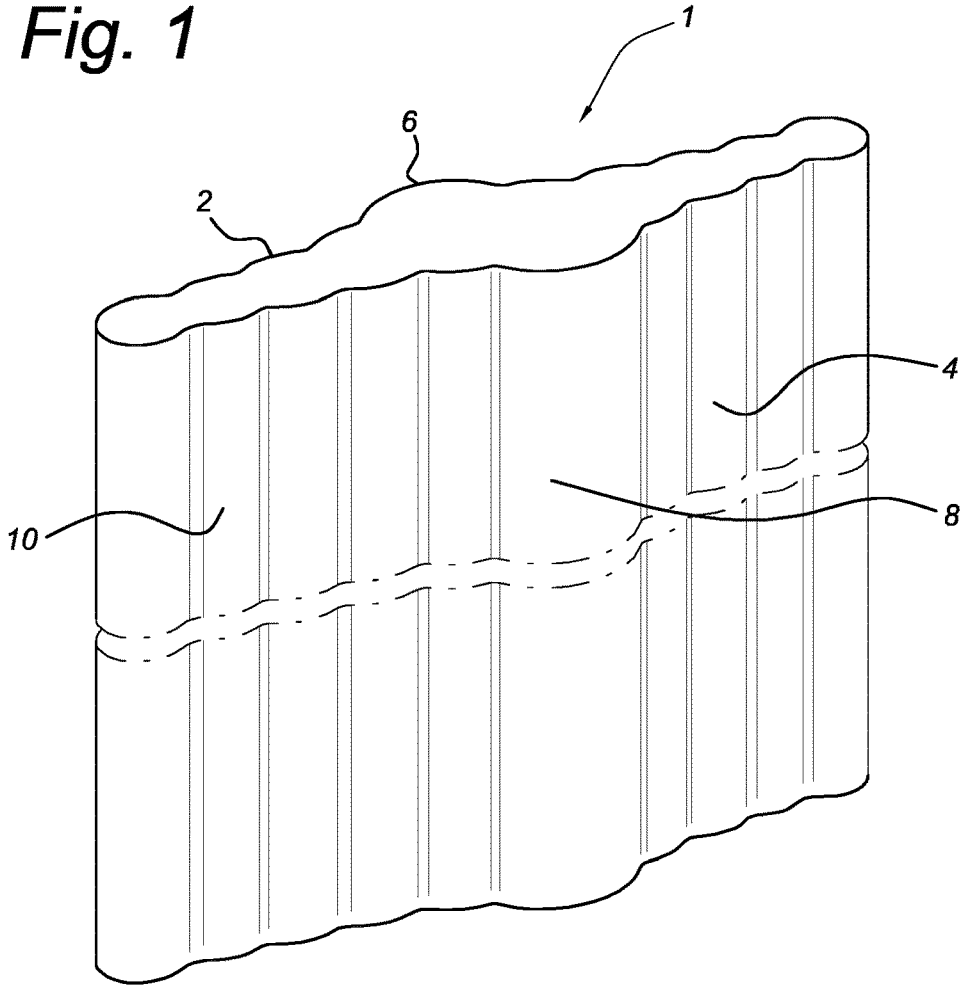
FIG. 1 depicts a perspective view of a fibre according to the present invention.

FIG. 1 shows a magnified perspective view of a fibre 1 according to the present invention. The fibre 1 is elongate and may be attached to a backing (not shown in this view), to maintain it in an upright position. The fibre 1 has a first face 2 and a second face 4, with a first ridge 6 extending down the first face 2 and a second ridge 8 extending down the second face 4. The faces 2, 4 are also provided with corrugations 10, of which the corrugations 10 extending down the second face 4 can be seen in this view.

The fibre 1 is an extrusion of metallocene ethylene-hexane copolymer having secant modulus MD (1% secant) of 111 MPa according to ASTM D882 and subjected to a draw ratio of 4.

Figure 2:
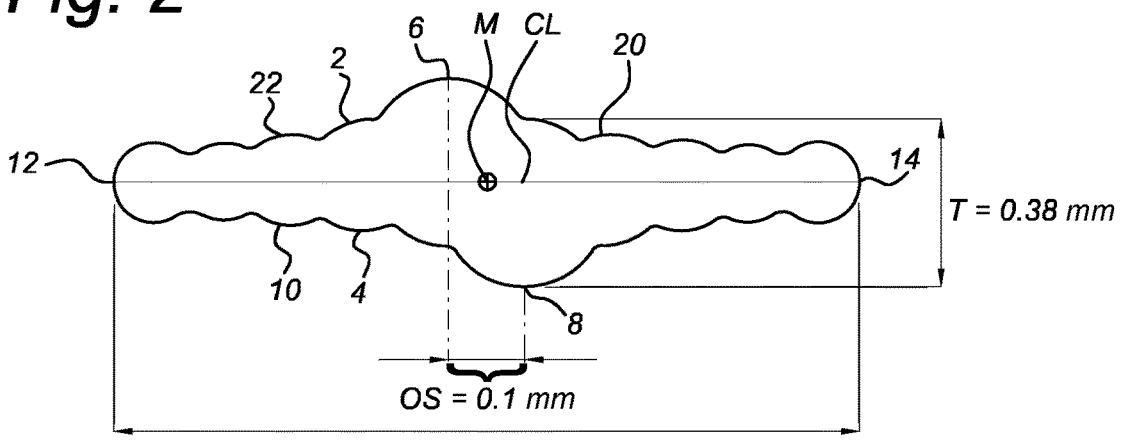
FIG. 2 depicts a cross-sectional view through the fibre of FIG. 1.

FIG. 2 shows the fibre 1 of FIG. 1 in cross-sectional view. It will be understood that due to the manner of manufacture by extrusion, the fibre is substantially identical at every cross section along the fibre length.

According to FIG. 2, the first and second faces 2, 4 extend between left and right side edges 12, 14. A centre line CL is shown joining the left and right side edges 12, 14. The centre line CL has a mid-point M. According to the invention, the first ridge 6 is offset from the second ridge 8 along the centre line CL away from the mid-point M. In other words, the first ridge 6 is closer to the left side edge 12 and the second ridge 8 is closer to the right side edge 14. The portion of the first face 2 between the first ridge 6 and the right side edge 14 is identified as the major face 20 and the portion of the first face 2 between the first ridge 6 and the left side edge 12 is identified as the minor face 22. Both the major face 20 and the minor face 22 are generally concave, while the first ridge 6 is convex.

The cross-section of the fibre 1 is such that it has 2-fold rotational symmetry. This means that the first face 2, when rotated through 180° about the mid-point M will coincide directly with the second face 4. Due to the offset between the first and second ridges 6, 8, there is no reflectional symmetry about the centre line CL or even about any other line.

In the illustrated embodiment, the centre line CL has a length L of 1.2 mm and the offset OS between the first and second ridges 6, 8 is 0.1 mm. A thickness T of the fibre 1 measured transverse to the centre line at the widest point is around 0.38 mm.

In addition to the first and second ridges 6, 8, the corrugations 10 on the first and second faces 2, 4 of the fibre 1 can also be seen in this view. There are a total of four corrugations 10 on the major face 20 and three corrugations 10 on the minor face 22. Additionally, the left side edge 12 and the right side edge 14 are both rounded. In order to avoid difficulties with splitting, the corrugations 10 are smoothly rounded in a continuous curve with no abrupt changes in contour.

Figure 3:
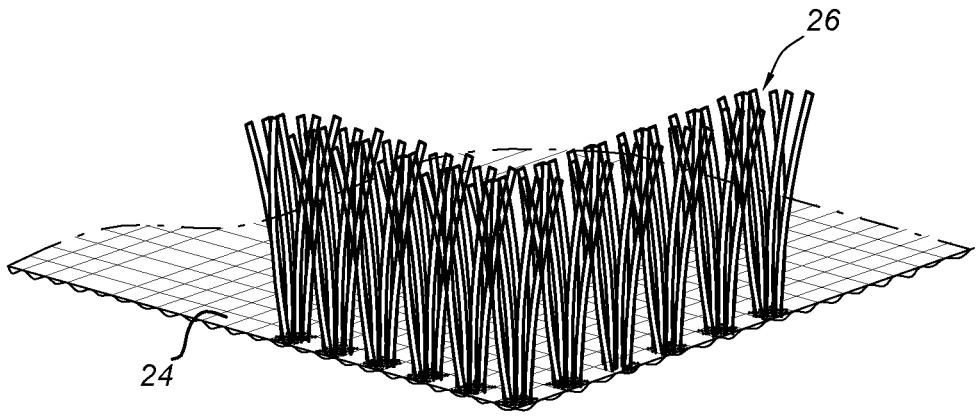
FIG. 3 depicts artificial turf incorporating the fibres of FIG. 1.

FIG. 3 shows a plurality of fibres 1 tufted into a backing 24 to form artificial turf 26. The turf was used in comparative testing as described below.

EXAMPLES

Example 1

A sample of artificial turf measuring 1 metre×3.70 metres according to FIG. 3 was prepared using bundles of six fibres having a bundle dtex of 12000. The pile height was 60 mm and the backing was double 100% PP Thiobac, black, U.V.-stabilized, weight ca. 222 gr/m$^2$ from Royal Ten Cate. The tufts were at ⅝ gauge (15 mm) with a spacing of 13.5 tufts per 10 cm in the length direction. The sample was installed on a concrete base and filled with a first stabilising layer of 5 mm sand infill followed by a 35 mm layer of performance infill comprising Genan fine SBR of particle size 0.7-2.0 mm, leaving a free pile height of 20 mm.

Example 2

A turf sample of Slide MAX XQ 60 from Royal Ten Cate measuring 1 metre×3.70 metres was installed on a similar basis to Example 1, using identical infill. The turf had the same dtex, tuft spacing and pile height as Example 1.

Example 3

A turf sample was prepared using Evolution™ fibres from Royal Ten Cate having dtex, tuft spacing and pile height as in Example 1 and measuring 1 metre×3.70 metres. The sample was installed on a similar basis to Example 1, using identical infill.

The artificial turf samples of Examples 1 to 3 were subject to repetitive testing using a Lisport XL testing machine. The Lisport™ XL is a new generation of wear simulation machines that realistically replicate wear simulation of sport fields after years of usage. The wear pattern is characterised by the compressive stress of football studs (cleats) and the abrasive wear caused by flat-soled sports shoes. It has been widely adopted by the industry as a means of producing realistic simulated patterns.

The test samples were tested through a total of 12000 cycles with intermittent checks every 3000 cycles. Cracking, splitting and resilience of the fibres were measured and documented at each check. The protocol for the checks were as follows.

Cracking

A crack is defined as an opening in the fibre, either at the top of the fibre or within its length.

Ten fibres were selected at random from the test area.

A mark was given for each fibre that did not exhibit a crack.

Splitting

A split is defined as a crack that extends from the top of the fibre to the infill layer.

Ten fibres were selected at random from the test area.

A mark was given for each fibre that did not exhibit a split.

Resilience the position of the top of 90% of the fibres as a percentage of the initial pile height is measured.

10 points given for 100% of the initial pile height.

9 points given for 90% etc.

Results

Based on a quantitative review of the test samples as described above, and after 12000 cycles, the fibres of the Examples scored as follows:

The fibres according to Example 1 scored values of 8 for cracking, 10 for splitting and 7 for resilience.

The fibres of Example 2 scored values of 10 for cracking, 10 for splitting and 4 for resilience.

The fibres of Example 3 scored values of 4 for cracking, 1 for splitting and 1 for resilience.

The samples were also visually inspected and it was apparent that the turf of Example 1 remained more upright than the other samples. The turf of Example 3 was particularly flattened.

Figure 4:
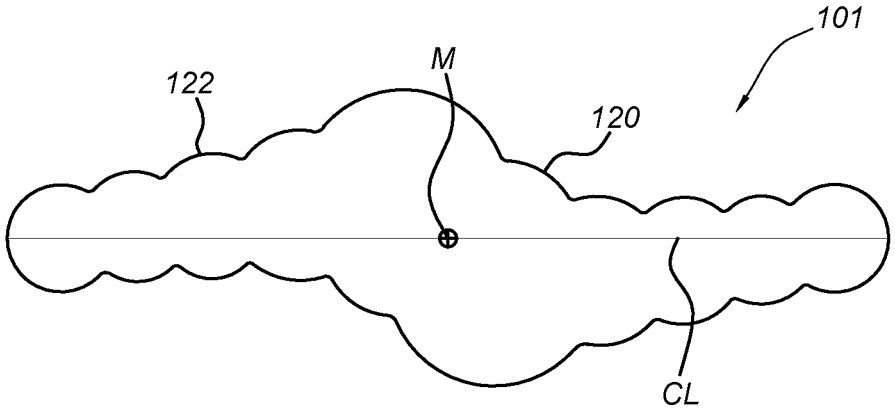
FIG. 4 depicts a cross-sectional view of a fibre according to a second embodiment of the invention.

FIG. 4 shows a second embodiment of a fibre 101 according to the invention in which like elements to the first embodiment have similar reference numerals preceded by 100.

The fibre 101 of the second embodiment is substantially identical to that of the first embodiment but for the curvature of the major face 120 and minor face 122. According to this embodiment, the major face 120 is substantially concave, while the minor face 122 is more or less straight. The resulting fibre 101 has greater asymmetry than the fibre 1 of the first embodiment.

Thus, the invention has been described by reference to certain embodiments discussed above. It will be recognized that these embodiments are susceptible to various modifications and alternative forms well known to those of skill in the art. In particular, the fibres of FIGS. 1 and 4 may be provided without corrugations and the positions and sizes of the ridges may be adjusted accordingly. Furthermore, although straight fibres have been described, the fibres may be formed as twisted or helical fibres by adjusting the post extrusion processing accordingly.

Many modifications in addition to those described above may be made to the structures and techniques described herein without departing from the spirit and scope of the invention. Accordingly, although specific embodiments have been described, these are examples only and are not limiting upon the scope of the invention.

The invention claimed is:

1. A fibre for use in artificial turf, the fibre having an elongate cross-sectional shape defining a first face and a second face that meet at side edges of the fibre, wherein a maximum thickness of the fibre is between 0.2 mm and 0.6 mm, determined based on a largest diameter circle that can fit within the cross-sectional shape and a ratio between the maximum thickness of the fibre and a length of a centre line extending between the side edges is between 0.3 and 0.6 and no part of the first and second faces crosses the centre line, wherein the largest diameter circle fits in a first position and a second position of the cross-sectional shape, wherein the first face has a first ridge which lies on a diameter of the largest diameter circle in the first position and the second face has a second ridge which lies on a diameter of the largest diameter circle in the second position, wherein the first ridge and the second ridge are offset with respect to each other and such that the cross-sectional shape is 2-fold rotationally symmetric with no reflectional symmetry.

2. The fibre according to claim 1, wherein the first and second faces have concave portions.

3. The fibre according to claim 1, wherein the first and second faces have corrugations.

4. The fibre according to claim 1, wherein the centre line has a length of between 0.5 mm and 2 mm.

5. The fibre according to claim 1, wherein the fibre has a dtex value of between 1500 and 3000.

6. The fibre according to claim 1, wherein the side edges are rounded and have a radius of curvature of at least 0.05 mm.

7. The fibre according to claim 1, wherein the first and second ridges are rounded and have a radius of curvature of at least 0.1 mm.

8. The fibre according to claim 1, wherein the first and second ridges are offset from each other along the centre line by a distance that is greater than 0.05×the centre line length but less than 0.4×the centre line length.

9. The fibre according to claim 1, wherein the fibre is an extruded monofilament.

10. The fibre according to claim 1, wherein the fibre consists of a polymer selected from the group consisting of: polyamides; polyesters; polypropylene; polyethylene; polyolefin block copolymers and blends and co-extrusions thereof.

11. The fibre according to claim 1, wherein the maximum thickness of the fibre lies between 0.2 mm and 0.6 mm.

12. Artificial turf comprising upstanding pile fibres according to claim 1, retained in a backing.

13. Artificial turf according to claim 12, wherein the pile fibres are tufted to the backing.

14. Artificial turf according to claim 12, wherein the pile fibres are woven together with the backing.

15. Artificial turf according to claim 12, wherein the pile fibres are mixed with further pile fibres having different cross-sectional shapes.

16. Artificial turf according to claim 15, wherein the further pile fibres comprise fill fibres being shorter than the pile fibres and serving to support the pile fibres in an upright position.

17. Artificial turf according to claim 12, wherein the pile fibres have a pile height of more than 4 cm.

18. Artificial turf according to claim 12, wherein the pile fibres extend in a plane of the backing over a fibre length of more than 10 mm.

19. A sports field comprising artificial turf according to claim 12.

20. A fibre for use in artificial turf, the fibre having an elongate cross-sectional shape defining a first face and a second face that meet at side edges of the fibre, the first and second faces having respective first and second ridges that are offset with respect to each other, wherein extremities of the side edges and extremities of the first and second ridges form a parallelogram and the first and second faces have concave portions such that surfaces of the fibre are displaced inwardly with respect to the surface of the parallelogram but no part of the first and second faces crosses a centre line extending between the side edges; and wherein a maximum thickness of the fibre is determined based on the largest diameter circle that can fit within the cross-sectional shape and a ratio between the maximum thickness of the fibre and a length of the centre line is between 0.25 and 0.6.

* * * * *